US006875086B2

(12) United States Patent
Golzarian et al.

(10) Patent No.: US 6,875,086 B2
(45) Date of Patent: Apr. 5, 2005

(54) SURFACE PLANARIZATION

(75) Inventors: Reza M. Golzarian, Beaverton, OR (US); Mansour Moinpour, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 111 days.

(21) Appl. No.: 10/340,876

(22) Filed: Jan. 10, 2003

(65) Prior Publication Data

US 2004/0147205 A1 Jul. 29, 2004

(51) Int. Cl.[7] ..... B24B 1/00

(52) U.S. Cl. ..... 451/41; 451/104; 451/291; 451/162; 451/290; 451/63

(58) Field of Search ..... 451/41, 164, 291, 451/162, 290, 63, 5, 285

(56) References Cited

U.S. PATENT DOCUMENTS 3,943,666 A * 3/1976 Dion et al. ..... 451/28
5,197,999 A 3/1993 Thomas
5,674,115 A * 10/1997 Yamashita et al. ..... 451/289
5,688,360 A * 11/1997 Jairath ..... 156/345.12
5,700,179 A * 12/1997 Hasegawa et al. ..... 451/41
5,707,274 A * 1/1998 Kim et al. ..... 451/285
5,735,731 A * 4/1998 Lee ..... 451/143
5,934,979 A * 8/1999 Talieh ..... 451/41
6,106,369 A * 8/2000 Konishi et al. ..... 451/41
6,136,138 A * 10/2000 Yagisawa ..... 156/345.12
6,227,956 B1 * 5/2001 Halley ..... 451/288
6,350,678 B1 2/2002 Pramanick et al.
6,413,152 B1 * 7/2002 Sengupta et al. ..... 451/66
6,521,079 B1 * 2/2003 Roy ..... 156/345.12
6,547,652 B1 * 4/2003 Roy ..... 451/285
6,572,441 B2 * 6/2003 Lukner et al. ..... 451/5
6,620,029 B2 * 9/2003 Khoury et al. ..... 451/6
6,652,354 B2 * 11/2003 Hayashi et al. ..... 451/5
6,663,480 B2 12/2003 Jeong et al.

* cited by examiner

*Primary Examiner*—George Nguyen
(74) *Attorney, Agent, or Firm*—Schwabe, Williamson & Wyatt, P.C.

(57) ABSTRACT

Embodiments of methods and apparatus in accordance with the present invention provide a chemical mechanical planarization (CMP) process that provides single or multiple polishing pads to have a different rotational velocity, applied pressure and oscillation frequency on the surface of the substrate to address and compensate for the WIW (with-in-substrate) and WID (with-in-die) non-uniformities in planarization ability. The velocity of each polishing pad is adjustable providing a closer match to the substrate surface velocity over a particular zone to yield a linear velocity on the surface of the substrate.

15 Claims, 3 Drawing Sheets

SURFACE PLANARIZATION

FIELD OF THE INVENTION

The present invention relates to apparatus and methods for chemical mechanical planarization and, more particularly, to large substrate planarization using multi-translational adaptive cylindrical polishing pads.

BACKGROUND OF INVENTION

Chemical mechanical planarization (CMP) is a popular method of planarizing the surface of a semiconductor substrate. CMP combines chemical etching and mechanical polishing to remove raised features on the surface of the semiconductor substrate. Planarity of the surface is a critical dimension for integrated circuit fabrication.

Standard practice is the use of a polishing pad mounted on a flat rotating platen, or turntable. The substrate is held in a carrier facing down and in contact with the polishing pad on the platen. The WIW (with-in-substrate) and WID (with-in-die) non-infirmities on the substrate surface are addressed by adjusting the back-pressure on the substrate, which in turn, alters the substrate's local shape with respect to the polishing pad. Platen to carrier rotational speed and carrier oscillation are also utilized to address these issues. Both approaches have their limitations due to the limited number of process parameters that can be controlled.

In an effort to increase production efficiencies, larger substrate sizes are becoming available. The current method for CMP is not adequate for these larger sizes. The polish non-uniformities are amplified with the increase in substrate diameter, which can contribute greatly to the WIW (with-in-substrate) and WID (with-in-die) non-uniformities.

The move of the industry toward using low and ultra low-K materials is also challenging current CMP processes. Metal delamination during the planarization process is caused by the weak adhesion between the low-K dielectric and the metal layer. CMP of low-K and ultra low-K substrate requires a process that provides low applied pressure and high velocity that is not easily obtainable with the current methods due to the limited number of process parameters that can be controlled.

Suitable apparatus and methods are needed for planarizing larger substrate, as well as improving the planarization of all substrate sizes, that are more reliable, consistent, and uniform.

DESCRIPTION

Figure 1:
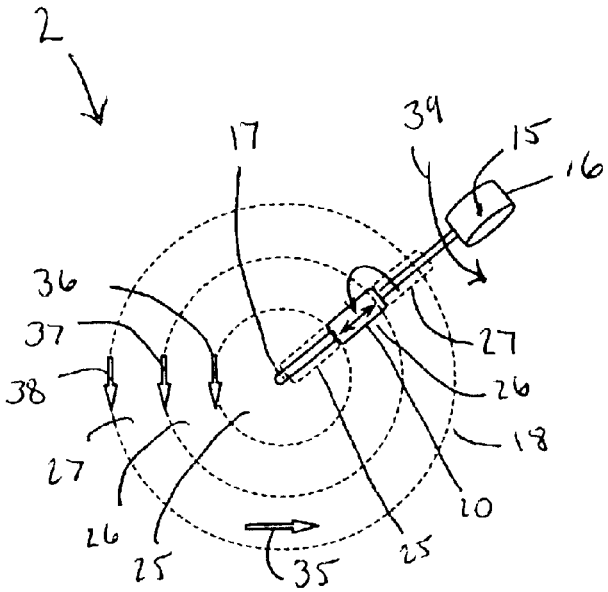
FIGS. 1–4 are top, side, side, and top views, respectively, of a CMP apparatus comprising a rotating substrate holder and a single cylindrical polishing pad coupled to a control arm.
Figure 2:
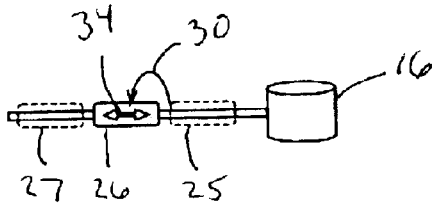

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Embodiments of methods and apparatus in accordance with the present invention provides a CMP methods and apparatus that provide single or multiple polishing pads each with individual control over various parameters to address and compensate for the WIW and WID non-uniformities in planarization ability. The velocity of each polishing pad is adjustable providing a closer match to the substrate surface velocity over a particular zone to yield a linear velocity on the surface of the substrate.

FIGS. 1–4 are top, side, side, and top views, respectively, of a CMP apparatus 2 comprising a rotating substrate holder 12 and a single cylindrical polishing pad 20 coupled to a control arm 16, in accordance with an embodiment of the present invention. The substrate holder 12 carries the substrate 13 in a horizontal position with the surface 14 of the substrate 13 to be polished facing upward. The substrate holder 12 is adapted to rotate the substrate 13 at a constant or variable velocity (Vs) 35 predetermined for a particular purpose.

The polishing pad 20 is cylindrically shaped and adapted to couple with the control arm 16 through the long axis. The length of the polishing pad 20 is less than the radius of the substrate 13. In the embodiment of FIG. 1, the length of the polishing pad 20 is approximately one-third of the radius of the substrate 13. In other embodiments, the polishing pad 20 is a given fraction of the radius of the substrate 13.

The control arm 16, when in operation, extends above the substrate holder 12 and substantially parallel with the substrate surface 14. The control arm 16 is adapted to pivot about a fixed point 15 adjacent the substrate holder 12 with a rotation velocity 39 and position 45. The control arm 16 is adapted to accept a cylindrical polishing pad 20. The control arm 16 is adapted to linearly translate the polishing pad 20 along the control arm 16 at a translation velocity (Vt) 34 and parallel with the substrate surface 14. The control arm 16 is adapted to position the polishing pad 20 at predetermined locations on the substrate surface 14 from at least the rotation axis 17 of the substrate holder 12 to the edge 18 of the substrate 13. In the embodiment of FIG. 1, three polishing pad 20 positions are defined as the center 25, middle 26 and edge 27 positions. The control arm 16 is adapted to linearly translate the polishing pad 20 within the three polishing pad positions and overlapping some portion of one or more polishing pad positions.

The control arm 16 is adapted to rotate the polishing pad 20 about the polishing pad's 20 long axis. The rotation velocity (Vp) 30 of the polishing pad 20 is variable and is selected for a particular purpose. In one embodiment of the method of the present invention, the Vp 30 of the polishing pad 20 is adjusted with radial position on the substrate 13.

The control arm 16 is adapted to place the polishing pad 20 in contact with the substrate 13 at a predetermined pressure (P) 40. The pressure 40 can be constant or continuously varied at one location or varied with position (Pc 41, Pm 42, Pe 43), along the radius of the substrate 13.

In an embodiment of the method of the invention, the pressure 40 is continuously varied across the substrate 13 and the polishing pad 20 is translated back and forth along the control arm 16 to compensate for the velocity differential along the radius of the substrate 13, from the rotation axis 17 to the edge 27. The velocity differential is greater as the radius of the substrate 13 is larger. The polishing pad 20 position and translation velocity (Vt) 34, polishing pad rotation velocity (Vp 35, Vc 36, Vm 37, Ve 38), pad pressure (P) 40, control arm rotation velocity (Cv) 39 and position (Cp) 45, and substrate 13 rotation velocity (Vs) 35 are controlled based on the feedback from an in-situ process/substrate surface 14 metrology system to address a particular non-uniformity on the surface 14 of the substrate 13.

In an embodiment of the method of the invention, the pad velocity (Vp) 30 of the polishing pad 20 is adjusted to provide a closer match to the substrate surface velocity (Vc 36, Vm 37, Ve 38) over a particular position to yield a linear velocity over the substrate surface 14.

FIGS. 5–8 are top, side, side, and top views, respectively, of a CMP apparatus 4 comprising a rotating substrate holder 12 with multiple cylindrical polishing pads 20*a*, 20*b*, 20*c* co-axially coupled to a control arm 46, in accordance with an embodiment of the present invention. The substrate holder 12 carries the substrate 13 in a horizontal position with the substrate surface 14 to be polished facing upward. The substrate holder 12 is adapted to rotate the substrate 13 at a constant or variable velocity predetermined for a particular purpose.

Figure 5:
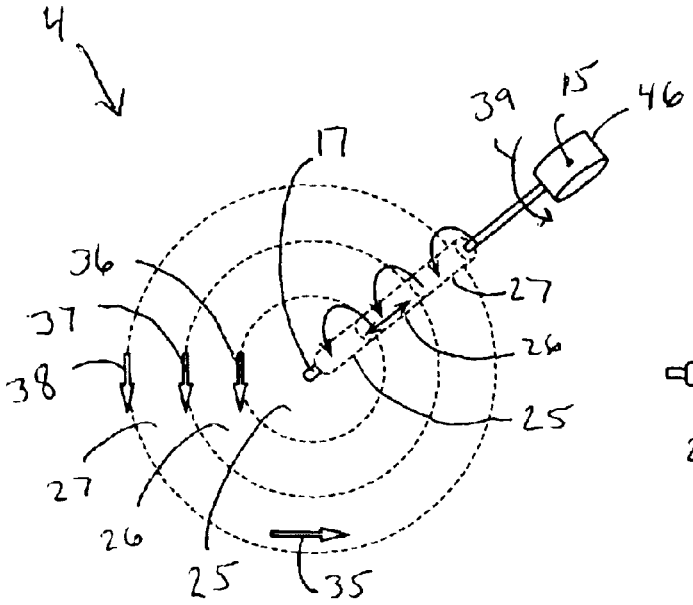
FIGS. 5–8 are top, side, side, and top views, respectively, of a CMP apparatus comprising a rotating substrate holder with multiple cylindrical polishing pads co-axially coupled to a control arm, in accordance with an embodiment of the present invention.
Figure 6:
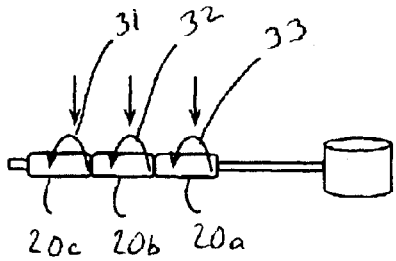
Figure 7:
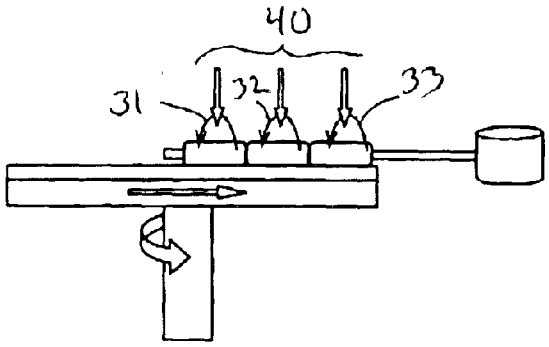
Figure 8:
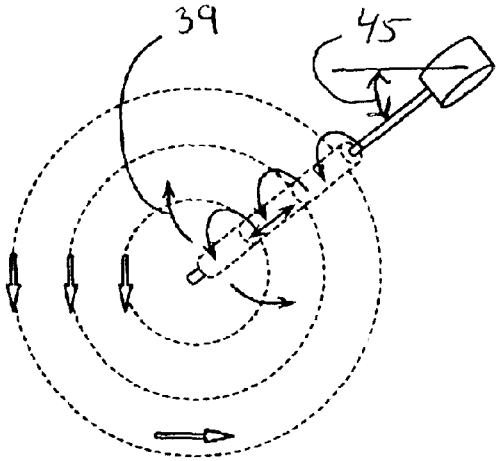

The polishing pads 20*a*–*c* are cylindrically shaped and adapted to couple with the control arm through the long axis. The length of each polishing pad 20*a*–*c* is less than the radius of the substrate 13. A plurality of polishing pads 20*a*–*c* is used simultaneously to cover the substrate surface 14. In the embodiment of FIG. 5, a plurality of polishing pads 20*a*–*c* is utilized and the length of each polishing pad 20*a*–*c* is approximately one-third of the radius of the substrate 13. In other embodiments, the length of each polishing pad 20*a*–*c* is a given fraction of the radius of the substrate 13.

The control arm 46, when in operation, extends above the substrate holder 12 and substantially parallel with the substrate surface 14. The control arm 46 is adapted to pivot about a fixed point 15 adjacent the substrate holder 12 in a sweeping manner with a control arm rotation velocity (Cv) 39 and position (Cp) 45. The control arm 46 is adapted to accept multiple cylindrical polishing pads 20*a*–*c*. The polishing pads 20*a*–*c* remain at a fixed position along the length of the control arm 46. The control arm 46 is adapted to place the polishing pads 20*a*–*c* parallel and in contact with the substrate surface 14. In the embodiment of FIG. 5, each of the three polishing pads 20*a*–*c* defines either a center 25, middle 26 or edge 27 position.

The control arm 46 is adapted to rotate the polishing pads 20*a*–*c* about the polishing pad's long axis. Each pad rotation velocity (Vpc 31, Vpm 32, Vpe 33) is variable, independent, and selected for a particular purpose. In one embodiment of the method of the present invention, the rotation velocity 31, 32, 33 of the polishing pads 20*a*–*c* is adjusted with radial position on the substrate 13.

The control arm 46 is adapted to place the polishing pads 20*a*–*c* in contact with the substrate 13 at a predetermined pressure (Pc 41, Pm 42, Pe 43). The pressure 41, 42, 43 can be constant or varied.

In an embodiment of the method of the invention, each pad rotation velocity 31, 32, 33 of each polishing pad 20*a*–*c* is selected to compensate for the substrate velocity 36, 37, 38 differential along the radius of the substrate 13. The velocity differential is greater as the radius of the substrate 13 is larger. The polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35 are controlled based on the feedback from an in-situ process/substrate 13 surface metrology system to address a particular non-uniformity on the substrate surface 14.

In an embodiment of the method of the invention, the velocity of each polishing pad 31, 32, 33 is adjusted to provide a closer match to the substrate surface velocity 35 over a particular position to yield a linear velocity over the substrate surface 14.

Figure 9:
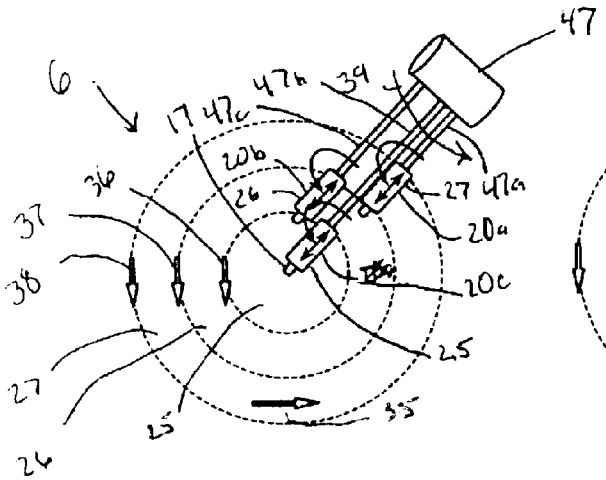
FIG. 9 is a top view of a CMP apparatus comprising a rotating substrate holder and a single cylindrical polishing pad coupled to each of three independent control arms coupled in parallel relationship to each other as a unit at a single pivot point, in accordance with an embodiment of the present invention.

FIG. 9 is a top view of a CMP apparatus 6 comprising a rotating substrate holder 12 and a single cylindrical polishing pad 21*a*–*c* coupled to each of three independent control arms 47*a*–*c* coupled in parallel relationship to each other as a unit 47 at a single pivot point 15, in accordance with an embodiment of the present invention. The substrate holder 12 carries the substrate 13 in a horizontal position with the substrate surface 14 to be polished facing upward. The substrate holder 12 is adapted to rotate the substrate 13 at a constant or variable velocity predetermined for a particular purpose.

Each polishing pad 21*a*–*c* is cylindrically shaped and adapted to couple with one of the control arms 47*a*–*c* through the long axis. The length of each polishing pad 21*a*–*c* is less than the radius of the substrate 13. In the embodiment of FIG. 9, the length of each polishing pad 21*a*–*c* is approximately one-third of the radius of the substrate 13. In other embodiments, each polishing pad 21*a*–*c* is a given fraction of the radius of the substrate 13.

Figure 3:
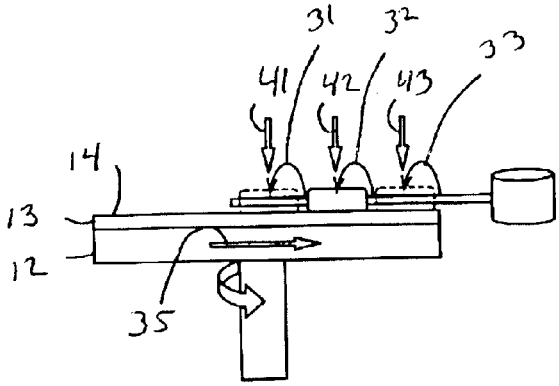
Figure 4:
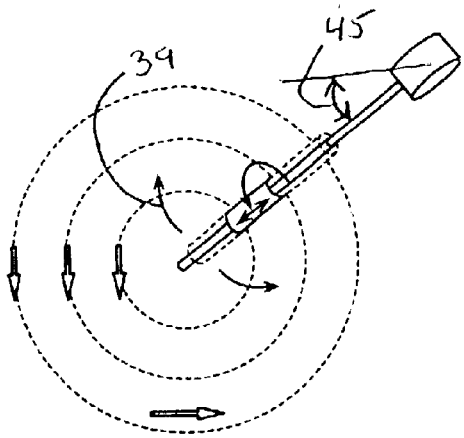

Each control arm 47*a*–*c*,when in operation, extends above the substrate holder 12 and substantially parallel with the substrate surface 14. The control arms 47*a*–*c* are adapted to pivot as a unit 47 about a fixed point 15 adjacent the substrate holder 12 in a sweeping manner at a rotational velocity (Cv) 45. Each control arm 47*a*–*c* is adapted to accept a cylindrical polishing pad 20*a*–*c*. Each control arm 47*a*–*c* is adapted to linearly translate a polishing pad 20*a*–*c* along the control arm 47*a*–*c* and parallel with the substrate surface 14. In the embodiment of FIG. 3, three polishing pad positions are defined as the center 25, middle 26 and edge 27. Each control arm 47*a*–*c* is adapted to position a polishing pad 20*a*–*c* at predetermined locations on the substrate surface 14: one control arm 47*a* positioning a polishing pad 20*a* at a defined center 25 position; one control arm 47*b* positioning a polishing pad 20*b* at a defined middle 26 position; and one control arm 47*c* positioning a polishing pad 20*c* at a defined edge 27 position. Each control arm 47*a*–*c* is adapted to linearly translate the polishing pad 20*a*–*c* either within at least one of the three polishing pad positions 25, 26, 27 and overlapping some portion of one or more polishing pad positions 25, 26, 27.

Each control arm 47*a*–*c* is adapted to rotate the polishing pad 20*a*–*c* about the polishing pad's 20*a*–*c* long axis. The polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35 are controlled based on the feedback from an in-situ process/substrate 13 surface metrology system to address a particular non-uniformity on the substrate surface 14.

The rotation velocity of each polishing pad 20*a–c* is variable and independent, and is selected for a particular purpose. In one embodiment of the method of the present invention, the rotation velocity of each polishing pad 20*a–c* is adjusted with radial position on the substrate 13.

Each control arm 47*a–c* is adapted to place the polishing pad 20*a–c* in contact with the substrate 13 at a predetermined pressure, independent from the other polishing pads 20*a–c*. The pressure can be constant or varied at one location or variable with position along the radius of the substrate 13.

In an embodiment of the method of the invention, the polishing pressure of each polishing pad 20*a–c* is varied across the substrate 13 and the polishing pad 20*a–c* is translated back and forth along the control arm 47*a–c* to compensate for the velocity differential along the radius of the substrate 13. The velocity differential is greater as the radius of the substrate 13 is larger. The polishing pad position 25, 26, 27 and translation velocity (Vtc 34*a*, Vtc 34*b*, Vte 34*c* ), polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35 are controlled based on the feedback from an in-situ process/substrate 13 surface metrology system to address a particular non-uniformity on the substrate surface 14.

In an embodiment of the method of the invention, the velocity of each polishing pad 20*a–c* is adjusted to provide a closer match to the substrate surface 14 velocity over a particular position to yield a linear velocity over the surface of the substrate 13.

Figure 10:
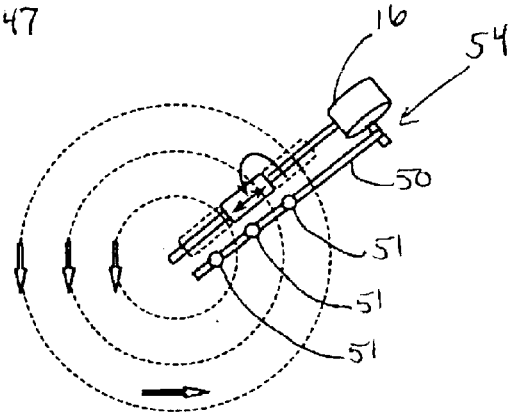
FIG. 10 is a top view of a slurry delivery system, in accordance with an embodiment of the present invention.
Figure 11:
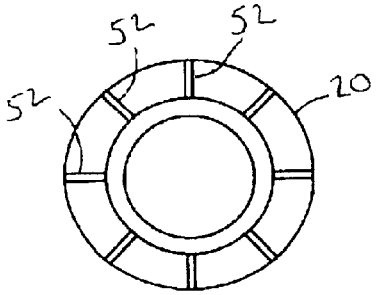
FIG. 11 is a side cross-sectional view of a polishing pad wherein the slurry and polishing solution is distributed through perforations in each polishing pad, in another embodiment in accordance with the present invention.

FIG. 10 is a top view of a slurry delivery system 54, in accordance with an embodiment of the present invention. In an embodiment in accordance with the present invention, the slurry and polishing solution distribution is through a slurry dispensing head 50 directly dispensed onto the substrate surface 14 at one or multiple ports 51. FIG. 11 is a side cross-sectional view of a polishing pad 20 wherein the slurry and polishing solution is distributed through perforations 52 in each polishing pad 20, in another embodiment in accordance with the present invention.

Figure 12:
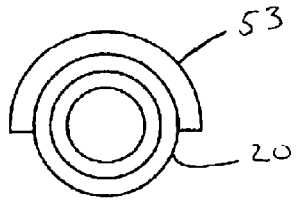
FIG. 12 is a side cross-sectional view of a polishing pad conditioning piece, in accordance with an embodiment of the present invention.

FIG. 12 is a side cross-sectional view of a polishing pad conditioning piece 53, in accordance with an embodiment of the present invention. The conditioning piece 53 has a semi-cylindrical shape with an inside diameter and length substantially the same as the outer diameter and length of the polishing pad 20. The conditioning piece 53 is adapted to condition, or clean, the polishing pad 20.

The embodiments of apparatus and methods in accordance with the present invention provide the ability to process larger semiconductor substrates more reliably, consistently and uniformly during the planarization process. The control over multiple process parameters provides the ability to process substrate 13 using very low pressure and very high rotational velocity that is particularly useful for planarization of ultra low-K materials. Similarly, the control over multiple process parameters provides the ability to prevent metal delamination during the planarization process, which is caused by the weak adhesion between the low-K dielectric and the metal layer.

The embodiments of apparatus and methods in accordance with the present invention provide the planarization to address the WIW (with-in-substrate) and WID (with-in-die) non-uniformities far more efficiently than any other systems on the market. As the diameter of substrate increases the velocity gradient across the substrate also increases; this methodology can address this issue efficiently by allowing single or multiple polishing pads move at different velocities and applied pressures on the substrate with an additional benefit of having the polishing solution dispensed at three different flow rates at different locations on the substrate. Furthermore, the embodiments enable the process of very low pad pressure on the substrate with a high substrate rotational velocity, which is required for ultra low-K integration.

The embodiments of apparatus and methods in accordance with the present invention provide single or multiple polishing pads to have a different rotational velocity, applied pressure and rate of linear positioning on the surface of the substrate to address and compensate for the WIW (with-in-substrate) and WID (with-in-die) non-uniformities in planarization ability. In this configuration, the velocity of each polishing pad can be adjusted such that it will match the substrate surface velocity over a particular zone to yield a linear velocity on the surface of the substrate. This enhances planarization of WIW and WID, and will allow the processing of very low pad pressure on the substrate with a high rotational velocity, which is required for ultra low-K integration.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A chemical mechanical planarization (CMP) apparatus for making semiconductor wafers, comprising:

a control arm configured to extend at least partially over a substrate; and at least one cylindrical polishing pad coupled to the control arm, the control arm configured to linearly translate the at least one cylindrical polishing pad along a length of the control arm, and to apply the at least one cylindrical polishing pad to a surface of the substrate.

2. The chemical mechanical planarization (CMP) apparatus as recited in claim 1, wherein the control arm extends over at least a radius of the substrate.

3. The chemical mechanical planarization (CMP) apparatus as recited in claim 1, wherein the apparatus further comprises a substrate holder that is configured to hold and rotate the substrate at a constant or variable velocity.

4. The chemical mechanical planarization (CMP) apparatus as recited in claim 3, wherein the control arm, is coupled to a pivot about a fixed point adjacent the substrate holder.

5. The chemical mechanical planarization (CMP) apparatus as recited in claim 1, wherein a length of the at least one cylindrical polishing pad is configured to be smaller than a radius of a substrate.

6. The chemical mechanical planarization (CMP) apparatus as recited in claim 1, wherein the control arm is configured to position the at least one cylindrical polish locations on a surface of the substrate.

7. The chemical mechanical planarization (OMP) apparatus as recited in claim 1, wherein the control arm is configured to rotate the at least one polishing pad about a longitudinal axis.

8. The chemical mechanical planarization (CMP) apparatus as recited in claim 1, wherein the control arm is configured to position the at least one polishing pad into contact with a surface of the substrate.

9. A method for planarizing a substrate with a chemical mechanical planarization (CMP) apparatus, comprising:

providing a cylindrical polishing pad to the CMP apparatus;

rotating the cylindrical polishing pad about a longitudinal axis of the cylindrical polishing pad;

linearly translating the cylindrical polishing pad along the longitudinal axis of the control arm; and applying the rotating cylindrical polishing pad to a surface of the substrate.

10. The method for planarizing a substrate with a CMP apparatus as recited in claim 9, wherein the method further comprises coupling the cylindrical polishing pad to a control arm, and extending the control arm over at least a portion of the surface of the substrate.

11. The method for planarizing a substrate with a CMP apparatus as recited in claim 10, further comprising:

moving the control arm with a pivot about a fixed point adjacent the substrate.

12. The method for planarizing a substrate with a CMP apparatus as recited in claim 11, wherein moving the control arm includes pivoting the control arm.

13. The method for planarizing a substrate with a CMP apparatus as recited in claim 12, wherein pivoting the control arm includes pivoting the control arm in a sweeping motion with a control arm rotation velocity.

14.The method for planarizing a substrate with a CMP apparatus as recited in claim 10, wherein rotating the cylindrical polishing pad includes adjusting a rotational velocity of the polishing pad.

15. The method for planarizing a substrate with a CMP apparatus as recited in claim 9, wherein applying the rotating cylindrical polishing pad includes varying polishing pressure across the substrate to compensate for a velocity differential along a radius of the substrate.

* * * * *

UNITED STATES PATENT AND TRADEMARK OFFICE

CERTIFICATE OF CORRECTION

PATENT NO. : 6,875,086 B2
APPLICATION NO. : 10/340876
DATED : April 5, 2005
INVENTOR(S) : Reza M. Golzarian and Mansour Moinpour It is certified that error appears in the above-identified patent and that said Letters Patent is hereby corrected as shown below:

Column 4
Lines 26-27, "...polishing pad 21 a-c..." should read --...polishing pad 20 a-c...--.
Line 36, "...polishing pad 21 a-c..." should read --...polishing pad 20 a-c...--.
Lines 38-39, "...polishing pad 21 a-c..." should read --...polishing pad 20 a-c...--.
Lines 40-41, "...polishing pad 21 a-c..." should read --...polishing pad 20 a-c...--.
Line 42, "...polishing pad 21 a-c..." should read --...polishing pad 20 a-c...--.
Line 49, "...velocity (Cv) 45..." should read --velocity (Cv) 39...--.

Column 6
Line 61, "...the control arm, is..." should read --...the control arm is...--.

Column 7
Line 5, "...(OMP)..." should read --...(CMP)...--.

Signed and Sealed this

Fifth Day of August, 2008

JON W. DUDAS
*Director of the United States Patent and Trademark Office*